United States Patent [19]

Schips

[11] Patent Number: 5,040,472

[45] Date of Patent: Aug. 20, 1991

[54] LABEL DISPENSER FOR SEWING MACHINES

[76] Inventor: Helmut Schips, Klosterweidlistrasse 1, CH-9010, St. Gallen, Switzerland

[21] Appl. No.: 379,013

[22] Filed: Jul. 12, 1989

[30] Foreign Application Priority Data

Jul. 15, 1988 [DE] Fed. Rep. of Germany ..... 3824090

[51] Int. Cl.[5] ..... D05B 3/12; D05B 3/22

[52] U.S. Cl. ..... 112/104; 112/113

[58] Field of Search ..... 112/104, 113, 114, 121.27, 112/265.1

[56] References Cited

U.S. PATENT DOCUMENTS

| | | | |
|---|---|---|---|
| 2,158,144 | 5/1939 | Oskow . | |
| 3,766,870 | 10/1973 | Weigert | 112/104 |
| 3,792,672 | 2/1974 | Friedman et al. | 112/104 |
| 4,030,429 | 6/1977 | Boser et al. | 112/104 |
| 4,813,361 | 3/1989 | Yunoki | 112/113 X |

FOREIGN PATENT DOCUMENTS

| | | |
|---|---|---|
| 2732488 | 4/1981 | Fed. Rep. of Germany . |
| 3410181 | 7/1986 | Fed. Rep. of Germany . |
| 1214048 | 11/1970 | United Kingdom . |

*Primary Examiner*—Werner H. Schroeder
*Assistant Examiner*—Paul C. Lewis
*Attorney, Agent, or Firm*—Dickstein, Shapiro & Morin

[57] ABSTRACT

A label dispenser in which data about the label length and the position of the reading marks on the labels is programmed into an electronic control mechanism which advances the labels accordingly by an electronically controlled stepping motor. A stationary light sensor is positioned a fixed distance from a knife blade and provides input to the electronic control. The electronic control may also control a clamp, a folding mechanism and a blowing mechanism.

4 Claims, 3 Drawing Sheets

LABEL DISPENSER FOR SEWING MACHINES

BACKGROUND OF THE INVENTION

The subject of the invention is a label dispenser for sewing machines, comprising, (a) a holding means for a label tape supply drum;

(b) a stepping motor for advancing the label tape in sections;

(c) a light sensor for detecting reading marks on the label tape;

(d) a clamping means for clamping the leading end area of the label tape;

(e) a knife for cutting off from the label tape a label clamped with its leading end area;

(f) a feed means for grasping each label and feeding it to the sewing machine to have it sewn on to sewing material; and (g) an electronic control means for the stepping motor, which can be programmed with data of the particular labels to be sewn on and to which the light sensor is connected.

In a known label dispenser for sewing machines, the label tape is advanced in sections by means of an asynchronous motor which is equipped with a brake. A light sensor detects reading marks on the label tape and controls the operation of the asynchronous motor and the cutting knife accordingly. If there is a change from one type of label to another, in particular to labels of a different length, mechanical stops of the label dispenser and the position of the light sensor along the label tape must be readjusted precisely and with difficulty. Furthermore, one cannot be fully certain that the labels will not twist or slip.

SUMMARY OF THE INVENTION

In the inventive label dispenser, no readjustment is required for a change to other labels. The light sensor can be stationary, in particular at a fixed distance from the knife blade. The functionally necessary data for the particular labels to be processed can be programmed into the electronic control means. These data preferably relate to the label length and the position of the reading mark on the labels. The label tape is advanced by the electronically controlled stepping motor more precisely than by the asynchronous motor with a brake. The labels can be processed faster and more reliably.

Preferred embodiments of the invention are stated in the claims and shall be explained in more detail below.

The label dispenser is preferably designed in such a way that it can provide either unfolded labels or folded labels, as one chooses, to be sewn on to sewing material. In the latter case the clamping means, with which a blowing unit optionally cooperates, can also be termed a folding means.

The electronic control means is preferably programmable in such a way that it controls not only the stepping motor but also other functions, in particular the clamping means or folding means, optionally the blowing means, the cutting knife, etc. Using the inventive label dispenser, the labels can always be folded exactly in the middle regardless of their length, without any danger of slipping or twisting.

The advancing of labels with the aid of the stepping motor and the folding of the labels can be carried out simultaneously. It is irrelevant whether the writing on the labels is to face the sewing material or face away therefrom.

BRIEF DESCRIPTION OF THE DRAWINGS

The invention shall be explained in more detail by way of example with reference to a preferred embodiment as in the drawing, in which.

DESCRIPTION OF THE PREFERRED EMBODIMENT

Figure 1:
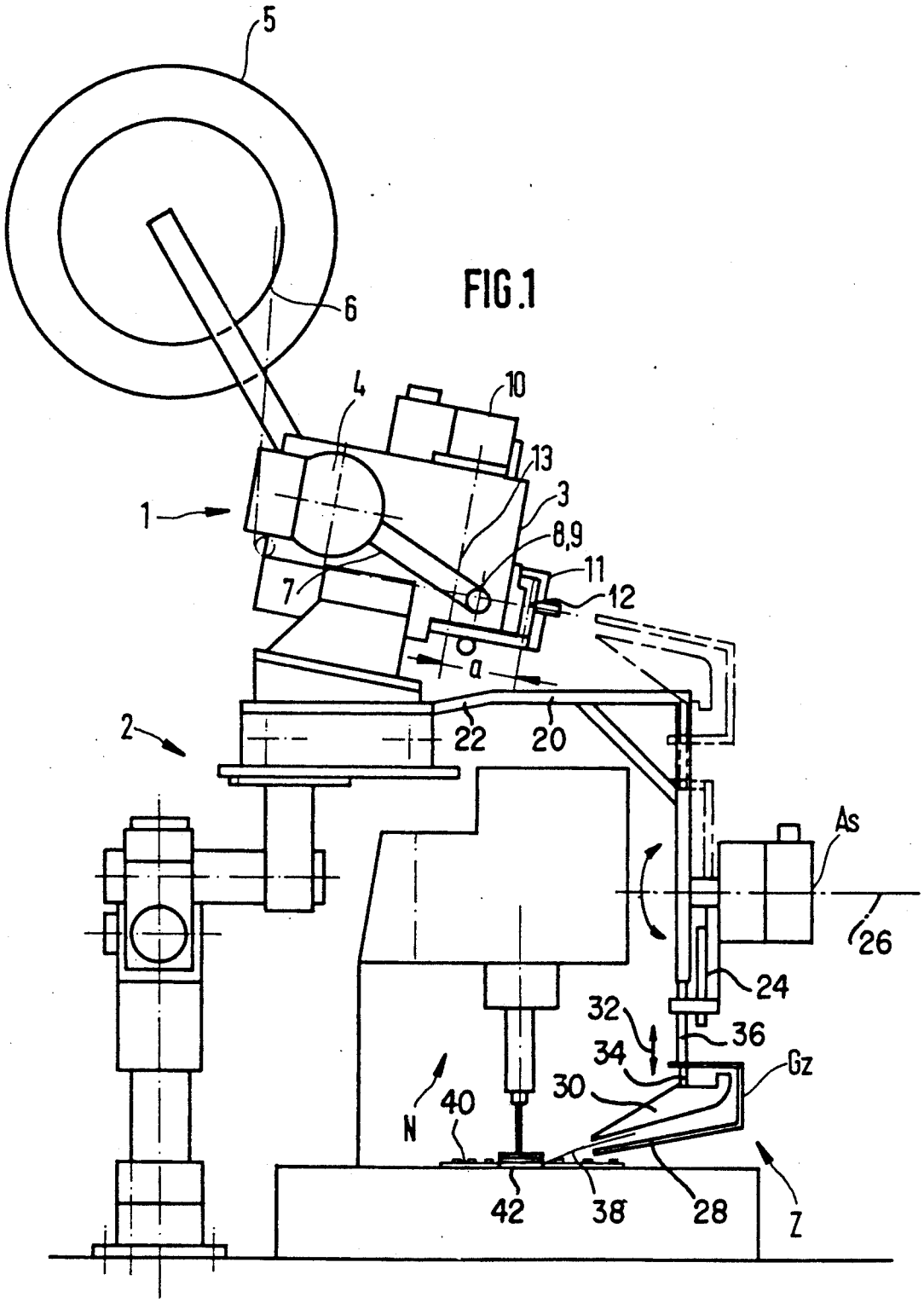
FIG. 1 shows an overall view of an inventive label dispenser provided on a sewing machine.

In FIG. 1, an inventive label dispenser 1 is disposed directly on the back of a sewing machine N by means of a frame 2 consisting of sections 20, 22 and having several degrees of freedom. On the front of sewing machine N there is a known feed means Z operated by a pivot drive As and supported by an arm 24 attached to frame member 20. The pivot drive As, is adapted to pivot the arm 180° about the axis 26 in order to position the arm 24 and the gripper Gz adjacent dispenser 1, as shown by the dashed lines in FIG. 1.

Figure 2:
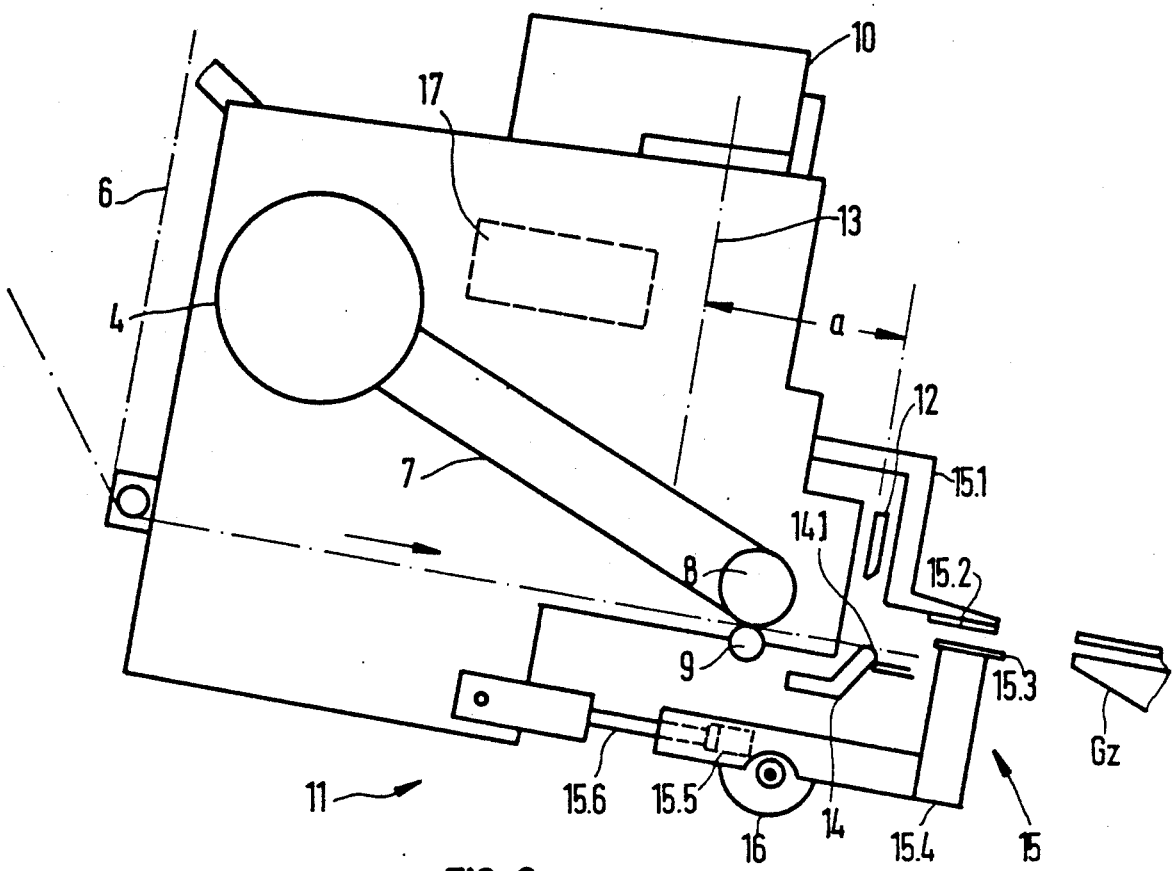
FIG. 2 shows schematically a longitudinal section of the folding means of the label dispenser of FIG. 1 on the sectional plane A—A indicated in FIG. 3.
Figure 4A:
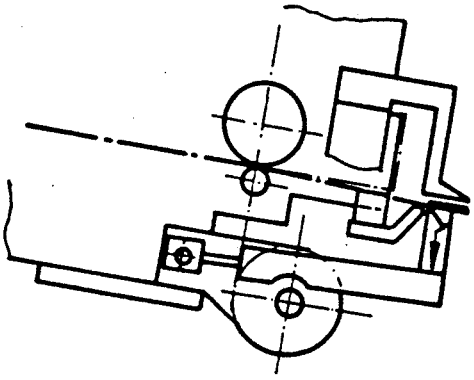
FIG. 4 shows a schematic view of the mode of operation of the folding means of FIG. 2 in six steps a to f.
Figure 4B:
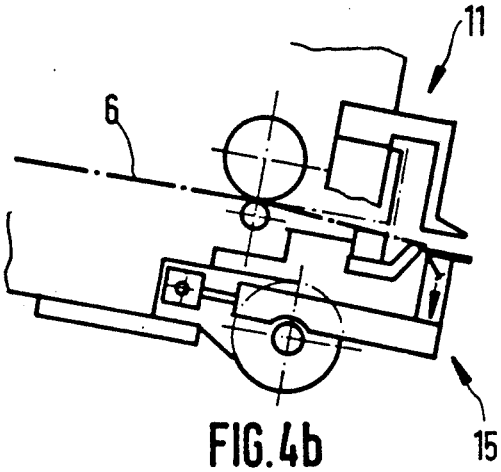
Figure 4C:
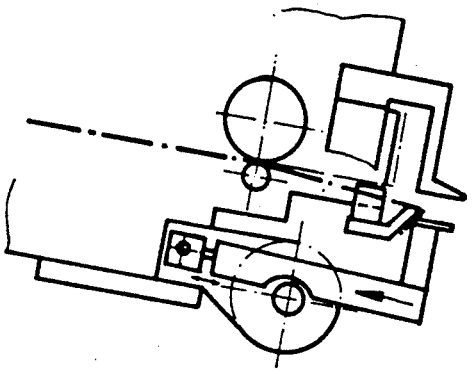
Figure 4D:
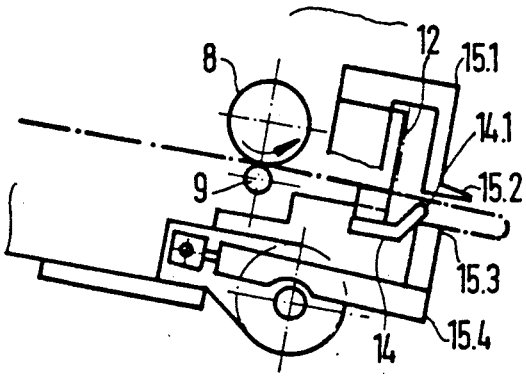
Figure 4E:
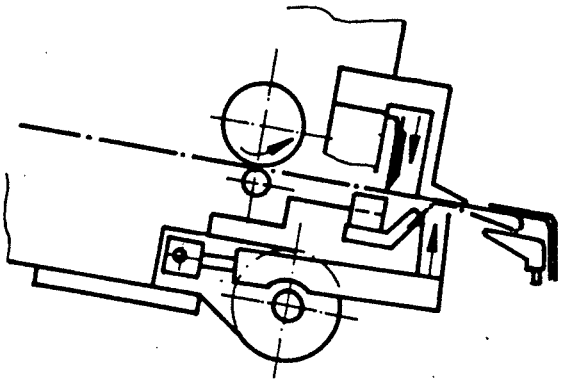
Figure 4F:
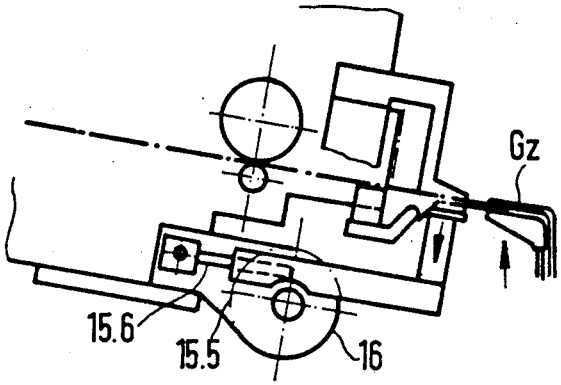

The gripper Gz has a first part 28 and a second part 30 which are movable relative to each other in order to open and close the gripper. FIGS. 1, 2 and 4*e* respectively illustrate the gripper Gz in an open position while FIG. 4*f* shows the gripper Gz in a closed position.

The upper part 30 of the gripper Gz is supported by a rod 34 which telescopically moves relative to a large diameter rod 36. As shown in FIG. 1, the gripper Gz is positioned to place the label 38 onto a textile product 40 at the sewing location 42. The label is then placed on the product extending slightly downwardly due to the force of gravity on the label. This feed means Z feeds to sewing machine N the labels 38 provided by label dispenser 1 in a position suitable for them to be sewn onto the particular sewing material 40. In housing 3 of label dispenser 1 there is an electric stepping motor 4 which drives transport rolls 8, 9 via a driving belt 7 to advance a label tape 6 coming from a supply drum 5 disposed outside housing 3.

The adjusting data required for correct label feed, namely the length of the labels used and the distance between the reading marks provided thereon and the leading edge of the label, are given to a programmable electronic control means. The latter can be housed also in housing 3 or outside label dispenser 1, as indicated by reference number 17.

The reading marks are detected by a light sensor 10 of the known type mounted in stationary fashion in housing 3. In the area of the right-hand lower corner of housing 3 one can also see a folding means 11 in FIG. 1 (cf. also FIG. 2) in which the labels, which are fed in metered fashion by transport rolls 8, 9 in accordance with the programmed adjusting data, are cut, possibly after being folded, off label tape 6 by a knife 12 and then transferred to waiting gripper Gz of feed means Z. The reading beam of light sensor 10 is fixed at a set distance a from the blade of knife 12.

Thanks to the inventive arrangement, one can dispense with the time-consuming adjustment of stops to preset a changed label length, and with an exact orientation of light sensor 10 to a new reading mark before each use of a different type of label. Although the reading mark is already ascertained by light sensor 10 during the label transport, the control means first has the programmed advance covered and then automatically triggers the further functional steps necessary.

Figure 3:
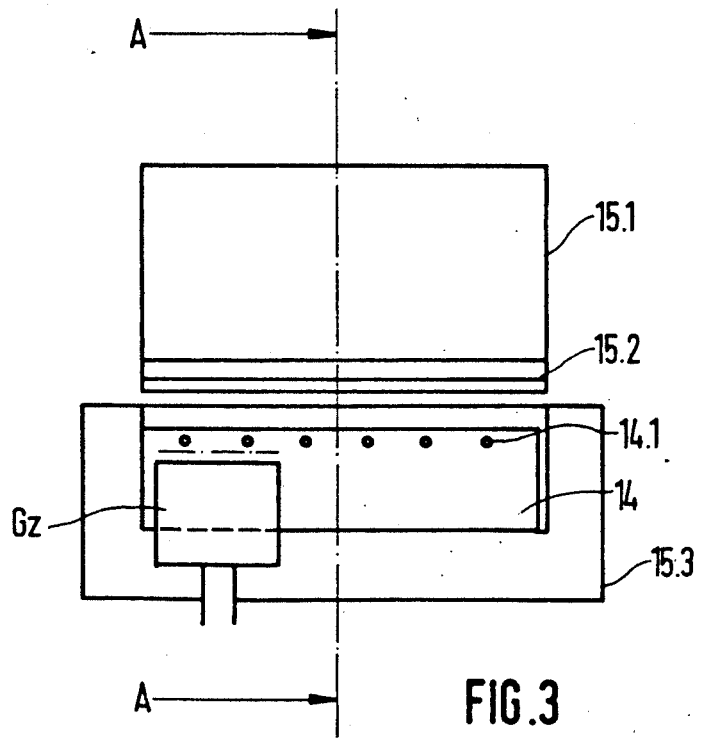
FIG. 3 shows a detail of the folding means as in FIG. 2.

Another, enlarged view of folding means 11 can be seen in FIG. 2. Under knife 12 there is a pneumatic blowing unit 14 within folding means 11. Knife 12 and blowing unit 14 are enclosed by a clamping means 15. Clamping means 15 has an upper clamping jaw 15.2 firmly connected with housing 3 by a twice bent arm 15.1, and a movable lower clamping jaw 15.3 hinged to a rotary drive 16 in eccentrically rotatable fashion by means of a once bent arm 15.4. To guide the combined pivotal and eccentric movement of lower clamping jaw 15.3 during operation, the hinged side of once bent arm 15.4 is also formed with a bore 15.5 which receives movably one end portion of a guide rod 15.6. The other end portion of guide rod 15.6 having a larger diameter is pivoted to housing 3. Pneumatic blowing unit 14 has the shape of a likewise bent flat channel and has at its end extending approximately to the level of the supplied label tape a plurality of nozzle openings 14.1 pointing in the advance direction of label tape 6 (cf. also FIG. 3). Knife 12 is mounted in a way known as such on a shaft which extends parallel to the plane of projection and is therefore invisible in FIG. 2. The swivel movement of knife 12 is then effected with the aid of a simple pressure cylinder via a lever which are also invisible in FIG. 2.

Opposite clamping means 15, FIG. 2 shows by broken lines the outlines of the jaws of gripper G of feed means Z.

The mode of operation of folding means 11 shall be explained with reference to FIG. 4 which shows, apart from the means in question, only the two transport rolls 8, 9, label tape 6 supplied therebetween and the line of action of knife 12. Before operation begins, the leading edge of a label is at the level of the knife blade, and clamping means 15 is closed at the moved out position of guide rod 15.6. The first three Figures a to c show the transport of label tape 6 that begins after folding means 11 has begun operation. First, label tape 6 is advanced a certain portion of the programmed total path as a first working step, toward the end of which clamping means 15 begins to open due to the downwardly beginning gyroscope movement of movable lower clamping jaw 15.3 (cf. FIG. a). In the course of a following second working step, label tape 6 is advanced a further portion of the necessary total path, and at the same time the opening between clamping jaws 15.2, 15.3 of clamping means 15 also widens further (cf. FIG. b). Guide rod 15.6 of movable clamping jaw 15.3 remains substantially in its moved out position during the two described working steps as in FIGS. a and b. This changes in the third working step according to FIG. c to the effect that movable lower clamping jaw 15.3 comes to lie against the opposing side face of pneumatic blowing unit 14 while moving guide rod 15.6 into its bore 15.5, thereby clamping the front portion of a label suspended thereover between these two parts.

If the folding of the clamped label is necessary, a fourth working step with guide rod 15.6 still in the moved in state involves an air jet out of each of nozzle openings 14.1 being directed against the label stretching over these openings 14.1, and at the same time label tape 6 being advanced (cf. FIG. d). This procedure allows for a label to be always folded exactly in the middle regardless of its length.

In the following fifth working step, clamping means 15 is closed by lower movable clamping jaw 15.3 coming to lie against stationary upper clamping jaw 15.2 while simultaneous moving guide rod 15.6 back into its bore 15.5. This causes the folded label to be held for severing from label tape 6 by means of knife 12. At the same time, the front part of the folded label protruding out of clamping means 15 penetrates into waiting gripper Gz of feed means Z (cf. FIG. e).

In a sixth working step, gripper G closes, taking the folded label out of clamping means 15 that is beginning to open. A new working cycle can commence (cf. FIG. f).

The inventive label dispenser allows for labels to be provided to be sewn into the sewing material in all three possible sewing positions, namely with the writing facing the sewing material, facing away therefrom or in a folded state.

If no folding is required, the label advanced via blowing unit 14 is cut off label tape 6 by knife 12 after clamping as in FIG. c and then conveyed on to gripper Gz, with its two sides being reversed, by the blowing from nozzle openings 14.1.

What is claimed is:

1. A label dispenser for sewing machines, comprising:

label dispensing means having arranged on a common frame comprising:

(a) holding means for a label tape supply drum;

(b) a stepping motor for advancing the label tape in sections;

(c) a light sensor for detecting reading marks on the label tape;

(d) clamping means for clamping a leading end area of the label tape;

(e) a knife for cutting off from the label tape a label clamped with said leading end area;

(f) electronic control means for the stepping motor, programmable with data of particular labels to be sewn on and connected to the light sensor; and transfer means supported by a mounting and including a gripper for grasping said label and transferring said label to a location where said label is sewn onto a sewing material by the sewing machine.

2. The label dispenser of claim 1, further comprising a pneumatic blowing unit having a plurality of nozzle openings pointing in a direction of feed the labels for blowing air jets against the labels clamped with their leading end areas.

3. The label dispenser of claim 1, wherein the clamping means has a stationary upper clamping jaw and a movable lower clamping jaw provided on an angular arm, and in that a rotary drive with an eccentric is provided for angular arm movements.

4. The label dispenser of claim 3, wherein a guide rod is provided for the angular arm, said rod being pivoted at one end to a housing of the label dispenser and extending at another end into a bore of the angular arm in longitudinally displaceable fashion.

* * * * *